US005971694A

United States Patent [19]

McNeilus et al.

[11] Patent Number: 5,971,694

[45] Date of Patent: Oct. 26, 1999

[54] PACKER WEAR SHOES

[75] Inventors: Garwin B. McNeilus; William P. Bartlett, both of Dodge Center, Minn.

[73] Assignee: NcNeilus Truck and Manufacturing, Inc., Dodge Center, Minn.

[21] Appl. No.: 08/792,880

[22] Filed: Jan. 31, 1997

[51] Int. Cl.[6] ..... B65F 3/00

[52] U.S. Cl. ..... 414/525.52; 414/525.5; 384/42; 100/233

[58] Field of Search ..... 384/40, 41, 42, 384/908, 909, 907; 414/513, 525.6, 525.5, 525.54, 525.51, 525.52, 525.53; 100/218, 233

[56] References Cited

U.S. PATENT DOCUMENTS

| | | | |
|---|---|---|---|
| 3,777,917 | 12/1973 | Herpich et al. | 414/525.52 |
| 4,029,224 | 6/1977 | Herpich et al. | 414/525.52 |
| 4,073,393 | 2/1978 | McKenzie et al. | 414/525.53 |
| 4,116,499 | 9/1978 | Laurizio | 384/42 X |
| 5,029,522 | 7/1991 | Brisson | 414/525.51 X |
| 5,560,713 | 10/1996 | Christenson . | |
| 5,785,486 | 7/1998 | McNeilus et al. | 414/513 |

FOREIGN PATENT DOCUMENTS

| | | | |
|---|---|---|---|
| 2421224 | 11/1975 | Germany | 384/42 |
| 163820 | 9/1983 | Japan | 384/42 |
| 2242240 | 9/1991 | United Kingdom | 384/42 |

*Primary Examiner*—Frank E. Werner

*Attorney, Agent, or Firm*—Nikolai, Mersereau & Dietz, P.A.

[57] ABSTRACT

This invention relates to improved replaceable wear shoes for use with the slide guides of rear-loading refuse trucks.

17 Claims, 10 Drawing Sheets

PACKER WEAR SHOES

BACKGROUND OF THE INVENTION

I. Field of the Invention

The present invention is directed primarily to truck bodies designed specifically for refuse hauling and, more particularly, to replaceable wear shoes for use with reciprocating mechanisms associated with the packing or ejecting systems of such vehicles.

II. Related Art

Refuse hauling trucks commonly include a truck body specifically designed for receiving, compacting, storing and discharging refuse materials and typically include all of the associated operating mechanisms. Mechanized packer and ejector systems are utilized on such truck bodies in the compacting of the refuse within the truck body and subsequent discharge of stored refuse from the truck body. Successful types of refuse processing vehicles include front or side loading vehicles in which the materials are loaded from the front or side of the vehicle into a charging or receiving hopper behind the cab thereafter processed rearward into a storage body by a rearward moving packer mechanism. Full reservoirs are emptied by or discharged through a rear door, the truck body typically being tilted to empty the contents. When closed, the door serves as the back wall of the storage compartment against which the material is packed. In certain embodiments, the packer mechanism may also aid in pushing the compacted material toward discharge from the rear of the storage compartment.

Rear-loading refuse handling truck bodies typically include a refuse handling reservoir designed for both loading and discharging from the rear of the vehicle. These truck bodies also include a rather large tailgate section that carries the receiving hopper portion and the compacting or packing mechanism. The blade packing mechanism includes a vertically pivoting hydraulic packer which operates to sweep material forward from the tailgate loading area. The packer operates together with and is rotatably attached to the lower end of a sliding storage compartment rear closing door or "slide" system. The compacting or packer system includes a hydraulic cylinder operating the rotating packer blade which operates repeatedly to compact refuse in a forward direction beneath and in front of the sliding door system each time sufficient refuse is loaded by hand or cart tipper into the rear of the tailgate section. After the packing stroke, the packer blade is rotated back to a position substantially parallel to the slide and the slide is retracted to again expose the loading area of the rear portion of the tailgate volume. In this manner, the slide reciprocates carrying the packing mechanism in association with each compaction operation.

The slide system also is supported in the recessed guides by wear shoes which have wear surfaces contacting the top and bottom of the recessed track carrying the slide mechanism and packer. Typically, two spaced shoes are bolted on either side of the slide system and a total of four shoes carry the slide in operation. No access is provided other than from inside the tailgate frame.

The slide system is also operated by a pair of hydraulic slide cylinders as it reciprocates supported along the pair of spaced parallel slide tracks or slide guides in the side walls of the tailgate such that the slide system reciprocates along a path at an acute angle with the plane of the vehicle.

The rear-loader also includes a reciprocating rail mounted blade-type ejector system against which the refuse is compacted and which is also cylinder operated to move forward and aft, on a horizontal plane, in the matter of a plow blade. A hydraulic cylinder, normally of the telescoping variety, mounted on the truck chassis just behind the cab is designed to be connected between the truck chassis and the ejector. The refuse is packed against the ejector incrementally by the hydraulic compacting mechanism cooperating with the slide closer system forcing the ejector forward in the truck body ahead of the compacting refuse until the ejector is fully forward when the storage body is packed to capacity.

In order to discharge the rear-loading truck body, the entire tailgate section of the truck body is unlocked and swung clear of the opening on top-mounted hinges and the ejector operated rearward in a power stroke to expel the entire contents of the refuse storage volume forcibly and without interference. Typically, the bottom portion of the ejector mechanism is supported on a plurality of load bearing sliders or wear shoes that ride in structural guide shapes or rails along which the ejector mechanism slides. These load bearing wear shoes are adapted to support the ejector system just above the truck body floor. With ejectors such as those used in the rear loaders that are supported on load bearing wear shoes, it will be appreciated that the wear shoes undergo a high amount of abrasive wear because of the weight and repeated reciprocal movement of the mechanism and the erosive and corrosive nature of many of the materials processed.

It will be appreciated that the wear shoes carrying both the ejector mechanism and the slide mechanism in a rear-loading packer are subject to a high degree of wear. Shoes of the class that provide bearing surfaces for most ejectors, slides and reciprocating packer systems wear rapidly and must be replaced on a frequent basis as part of normal maintenance. Replacement of the shoes can be a difficult and time consuming project and this is particularly true with respect to the slide wear shoes associated with rear-loading packers. The shoes are typically bolted on to the outside of the slide assembly and, since they are carried in recesses in the side of the tailgate, access to the bolts is extremely difficult from a maintenance standpoint. In addition, the shoe surfaces and, of course, the bolts are exposed to corrosive and oxidizing refuse materials which tend to cause rapid corrosion, thereby increasing the difficulty of removal.

Time consuming maintenance items represent serious drawbacks with respect to the operating costs and desirability of particular refuse collection vehicles and innovations which reduce necessary scheduled maintenance costs represent significant advances in the art. Reducing the frequency and time required to renew wear shoes particularly slide shoes in rear-loading refuse bodies would be a much desired improvement.

Accordingly, it is a primary object of the present invention to provide a wear shoe system that significantly reduces the frequency and complexity of replacement.

Another object of the present invention is to provide a replaceable wear shoe system that reduces corrosion and increases wear shoe life.

Yet another object of the present invention is to provide a replaceable wear shoe system that eliminates the need for bolting the shoes in place.

Still another object of the present invention is to provide a relatively lightweight, less expensive wear shoe in which upper and lower high wearing, low friction slide surfaces are spaced by less expensive, relatively lightweight filler material.

Other objects and advantages become apparent to those skilled in the art upon further familiarization with the specification, drawings and appended claims contained herein.

SUMMARY OF THE INVENTION

The present invention is directed to improvements in reducing maintenance frequency and complexity with regard to packer and ejector wear or friction surfaces in refuse processing vehicle bodies. More particularly, the invention addresses this topic with regard to wear shoes that reciprocate in rails or slide guides carrying moving mechanical parts of the refuse processing system. The improved wear shoe system of the invention contemplates both improvements in the wear shoes themselves and accomplishes reductions in the complexity and time consuming nature of wear shoe replacement. Improved shoes include longer wearing friction surfaces and the simplified shoe construction that is less expensive and lighter weight.

The wear shoe of the wear shoe system of the invention employs speciality upper and lower, low friction, low abrasion wear surface pads flat or shapes spaced by a composite core of low density, low cost polymer or other filler material of sufficient strength and abrasion resistance to endure the weight and shoe environment. In addition, with respect to the core or filler material, certain polymer materials known as ultra high molecular weight (UHMW) materials including high density polyethylene (HDPE) work well. The pads are attached to the core material as by rivets, or the like, possibly in the manner of conventional break linings or pads. The shoe core is provided with a plurality of recesses or bores adapted to fit over pegs or pins carried by a slide or ejector mechanism with the shoe being contained in place on the pegs or pins by the side wall of the rail or slide guide, as the case may be. The rear loader slide guide system further features one or more access openings provided in each tailgate assembly side wall that allows one to access the shoes by removing a cover plate and positioning the slide so that the shoe is exposed. An additional bore may be provided in the central composite filler to facilitate handling of the exposed shoe for removal and replacement. The wear shoe is simply pulled off the mounting pins and a new shoe popped on. The slide can then be moved to expose the second shoe also for replacement or spaced accesses used to expose both at once. Thereafter, the access plate(s) is(are) replaced and the maintenance task accomplished.

The materials of construction of the wear shoes or wear pads of the shoes are an important aspect of the invention inasmuch as reduced surface friction, longer wearing (lower abrasion) and lighter weight materials are most desired. The materials should be relatively inert to the materials processed. Accordingly, high impact, abrasion resistant and self-lubricating polymer materials are preferred. Such materials offer greater wear surface life than conventional steel, bronze or other metallic surfaces. They are lighter weight and can readily be cast polymerized into the exact shape required for the particular application.

Examples of polymer products include a series of modified polyamide, particularly nylon products, examples of which are sold under the trademark "Nylatron" (Polymer Corporation, Reading, Pa.). One such material known as GSM cast nylon can be directly polymerized from the monomer into the shape of the article desired producing either simple or complex shapes free of voids and in sizes larger than those possible with conventional extrusion. These nylons may also be modified by incorporation or impregnation with friction reducing oils and molybdenum disulfide ($MOS_2$) which improves mechanical thermal and bearing properties of type 6/6 nylon, for example.

Of course, other materials which have the requisite physical properties and lend themselves to manufacture in the desired shapes and sizes can also be used. Other examples of such material include polyetheretherketone (PEEK), modified, partially crystallized polyethylene terephthalate thermoplastic polyester, thermoplastic acetyls and other materials. It will further be appreciated that the shoes and pads may be of shapes other than those illustrated and described in the detailed description, which is exemplary rather than limiting in any respect.

It will further be recognized that the wear shoes of the invention can be made of a single continuous or partially hollow block of any of the polymer or modified polymer materials described above including the UHMW materials and HDPE. Also, such materials may be combined with one or more wear pads or wear plates of other lower wear materials such as modified polyamide materials. In this manner, the wear shoes can be formed of a single cast or molded shape requiring no assembly whatever and simply being installed on and removed from the slide as described. Some materials, particularly certain of the polyimide materials, can be directly polymerized from the monomer into this final desired configuration or "cast polymerized".

Additionally, different materials including conventional metal materials, such as bronze, brass and steel, for example, may also be used for some or all of the wear surfaces.

BRIEF DESCRIPTION OF THE DRAWINGS

In the drawings, wherein like numerals designate like parts throughout the same.

DETAILED DESCRIPTION

The present invention will be described hereinafter particularly with respect to utilization of the wear shoe system with reference to the slide and slide guide of a rear-loading refuse processing vehicle body. This does represent an important embodiment with respect to the application of the wear shoe system of the invention, however, it is by no means limiting with respect to the application of the inventive concept and is meant to be interpreted by way of example and it is not intended to limit the scope of the invention or to preclude any other applications.

Figure 1:
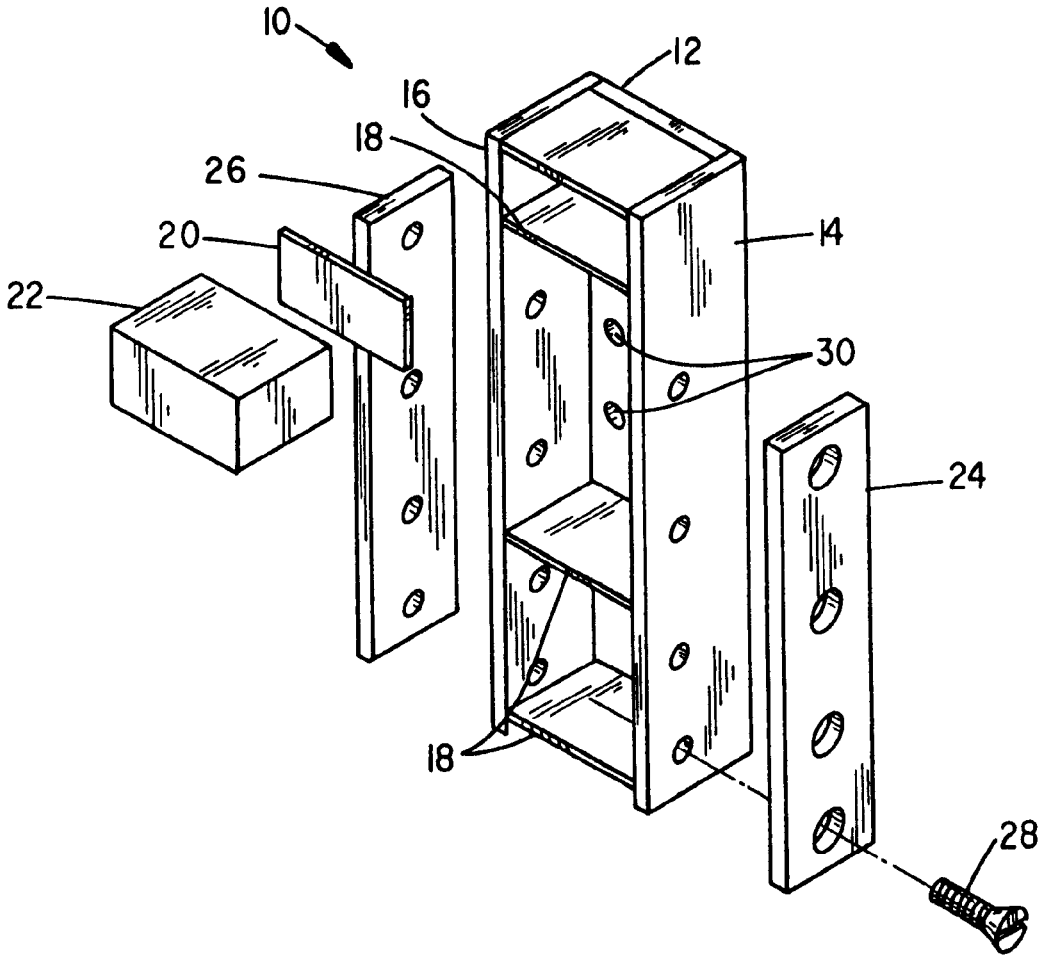
FIG. 1 (PRIOR ART)
FIG. 1 is an exploded perspective view of a wear shoe utilized in the prior art.
Figure 3:
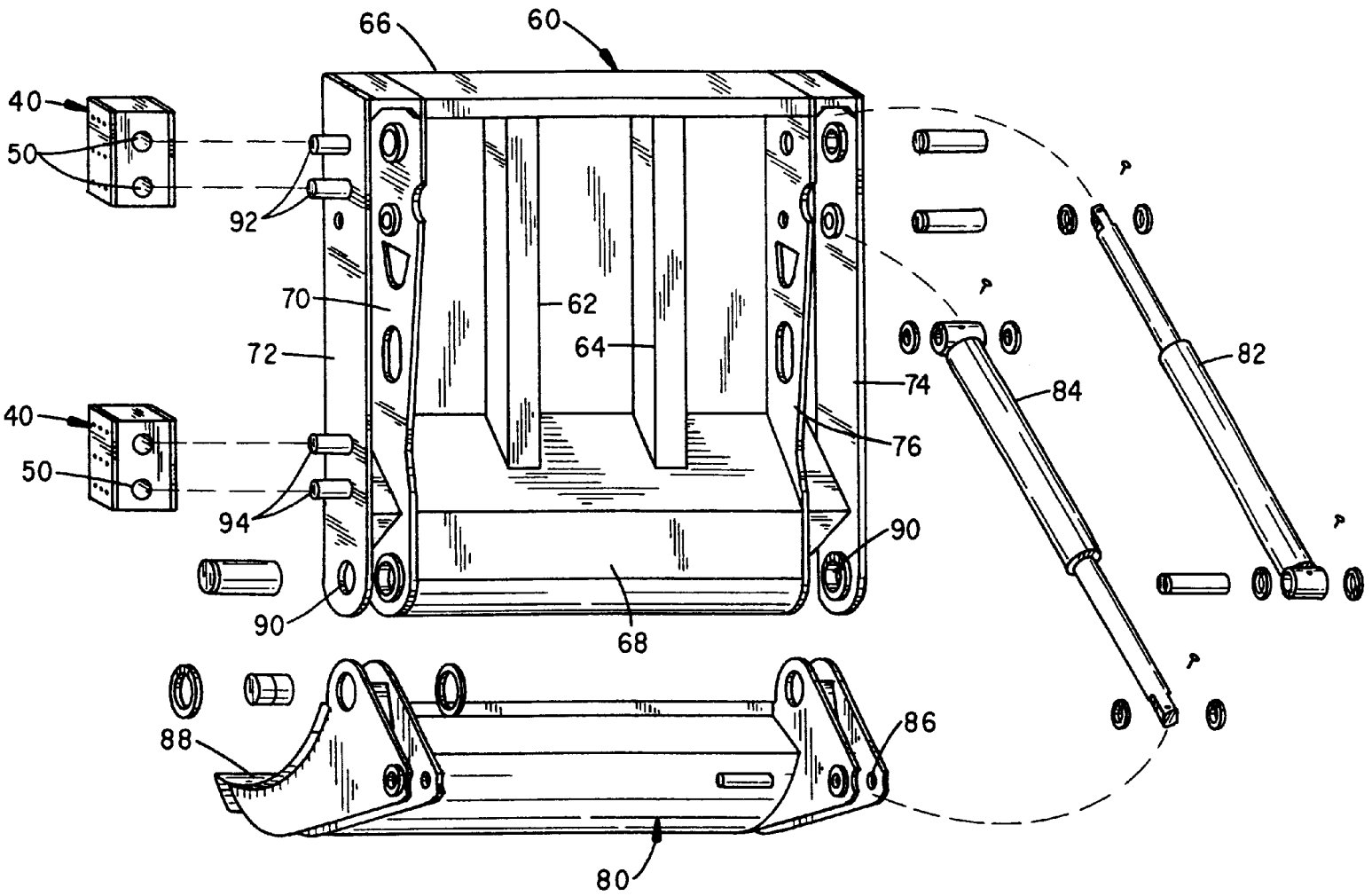
FIG. 3 is an exploded view of a slide and packer system of a rear-loading refuse truck, including the wear shoes of the invention.

Conventional wear shoes of the class contemplated for use with the slides of rear-loading refuse vehicles are shown generally in FIG. 1 in which the wear shoe 10 includes a rigid, generally a U-shaped, three-piece metallic frame, having a rear or side plate 12 flanked by what in actual use become upper and lower members 14 and 16 welded thereto. The frame may be stiffened by spaced internal plates 18 and one or more filler blocks and plates as at 20 and 22. Upper and lower wear surface plates are shown at 24 and 26 and are fastened to the frame members 14 and 16 as by screws or bolts representatively illustrated at 28. The wear shoe 10 itself is bolted on to a slide side structural member in one of the positions as illustrated in FIG. 3 by a series of bolts (not shown) through openings as at 30. As can be seen from FIG. 1, the prior shoes typically required assembly of 10 or more parts laboriously assembled together using welding and other fastening techniques. In addition, each shoe then had to be bolted on to the slide in a position difficult to access at best. The bolts tended to corrode in place making removal even more difficult and time consuming.

This may be contrasted with the shoes of the present invention illustrated generally at 40, 54 in FIGS. 2A, 2B, 2C and 2D. The shoes are of simplified construction and the shoes of FIGS. 2A and 2B include spaced upper and lower wear bars or pads 42 and 44 and an optional outer facing pad 46 spaced by a block of composite material 47 to which the plates 42, 44 and 46 are fixed as by a plurality of bolts or rivets countersunk in openings as at 48. The inside of the wear shoe includes a pair of spaced recesses or bores 50 designed to fit over corresponding pegs or pins 92 or 94 provided in the slide side wall as illustrated in FIG. 3. The opposite side contains an additional recess or bore 52 which is employed in removing the shoe outwardly from the pegs.

Figure 2A:
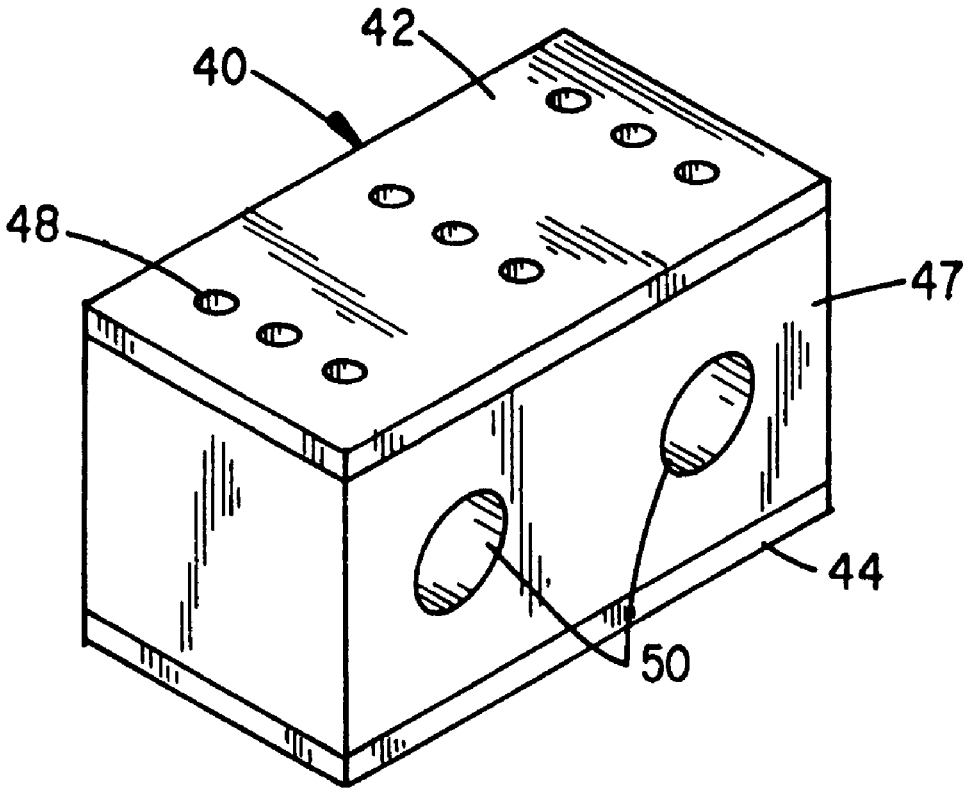
FIGS. 2A, 2B, 2C and 2D are respective views of wear shoes fabricated in accordance with the present invention.
Figure 2B:
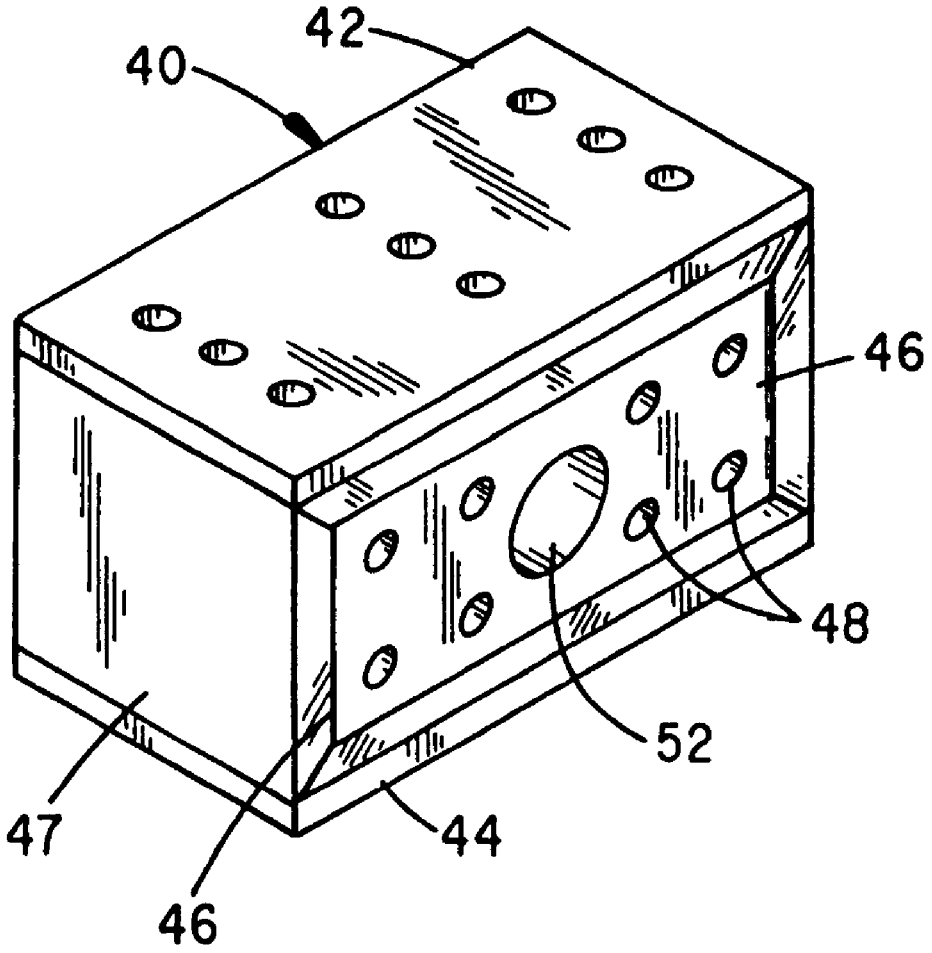
Figure 2C:
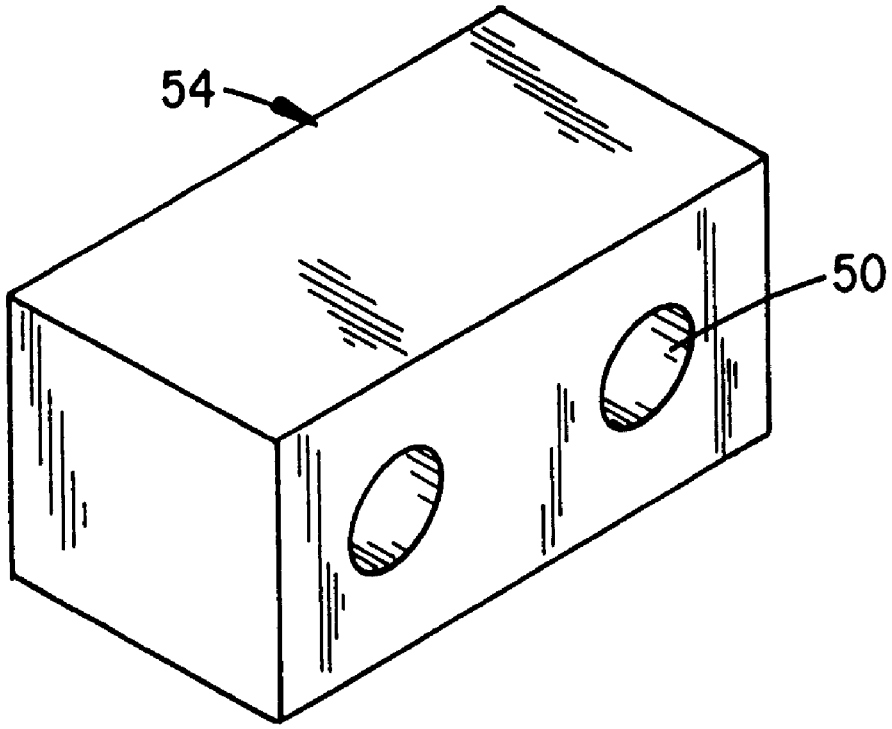
Figure 2D:
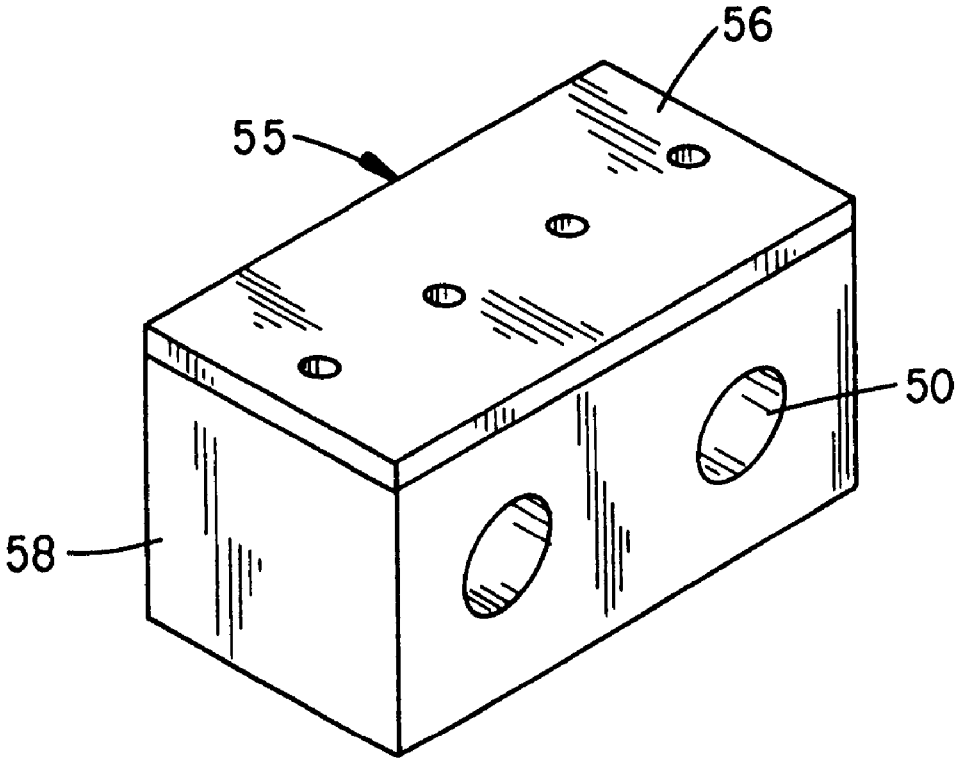

Note that the assembled wear shoe of FIGS. 2A and 2B contains only three or four parts and requires no welding or bolting whatsoever in its assembly, and mounting onto the slide of the rear-loading refuse vehicle body. It is also quite possible, however, to make successful shoes in accordance with the invention of a single solid or partially hollow block of wear pad material. FIG. 2C depicts an alternative embodiment 54 in which the wear shoe is made entirely of a single block of relatively low friction material or of a high MW material such as high density polyethylene (HDPE). In this manner, it is possible to construct a wear shoe of a single molded piece which requires no further processing. Of course, the surfaces and openings can be further processed as by machining, or the like, if necessary or desired. FIG. 2D depicts yet another variation at 55 in which a low abrasion, low friction surface pad 56 is fastened to a HDPE block 58. Pad or wear bar 56 is fastened to the side of block 58 normally subject to the greatest amount of wear. In the case of a rear packer slide assembly, this is typically the top side.

FIG. 3 depicts an exploded view illustrating a slide assembly and packing panel typically utilized in a rear-loading refuse vehicle body. The slide, generally at 60, includes stiffener or strengthening shapes as at 62 and 64 and cross member shapes as at 66 and 68 to form a rigid structure. Pairs of spaced longitudinal side strut members as at 70, 72, 74, and 76 flank the slide member and support the connections to operating cylinders and the rotating packer mechanism 80. The slide is moved relative to the tailgate assembly utilizing a pair of cylinders, one of which is shown at 82, and the packer 80 is rotated relative to the slide utilizing a pair of double-acting hydraulic cylinders, one of which is shown at 84, fastened between the upper portion of the slide and a connection at 86 on the packer assembly 80 which rotates the packer assembly including packer blade 88 about the pivot joints as at 90. The other cylinders of the pairs (not shown) are mounted to operate the system on the other side of the slide panel.

The slide panel is also provided with pairs of spaced pegs as at 92 and 94 which protrude from the outer side wall member as at 72 to receive the recesses or bores 50 of the corresponding pair of wear shoes 40, 54, 55 illustrated on one side of the slide 60. As in the case of the cylinders 82 and 84, of course, a pair of identically configured and mounted wear shoes are carried on the opposite side of the slide 60 and need not be illustrated here.

Figure 4:
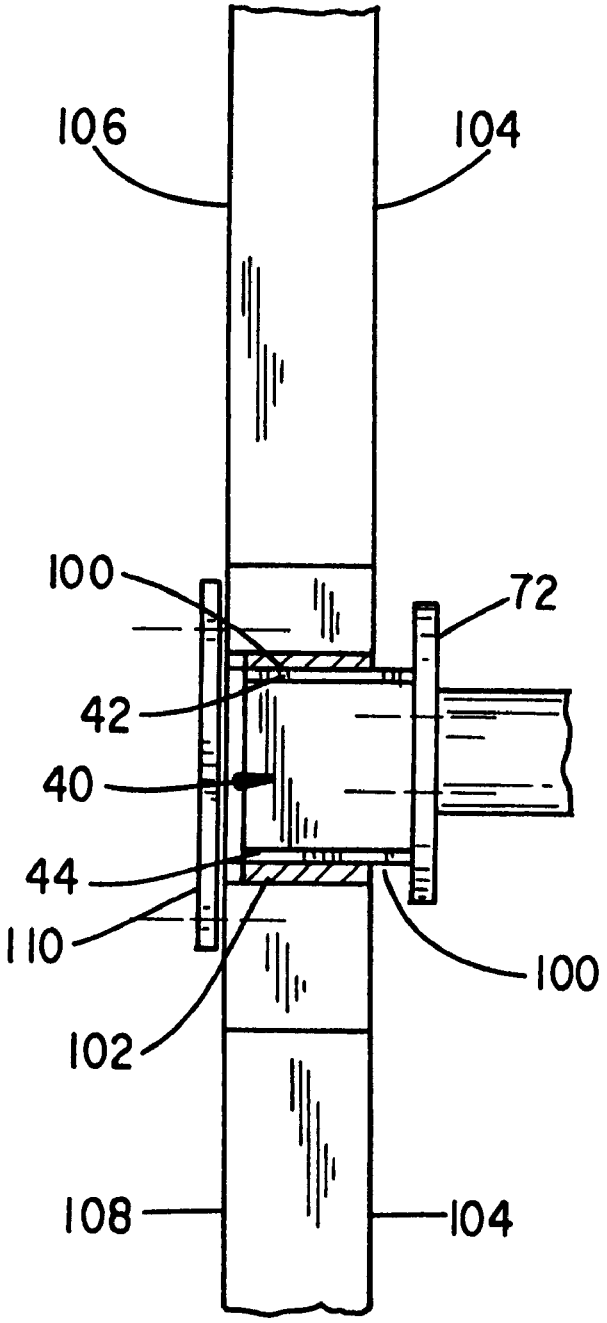
FIG. 4 is a schematic fragmentary side elevational view showing the slide guide and shoe arrangement.
Figure 6A:
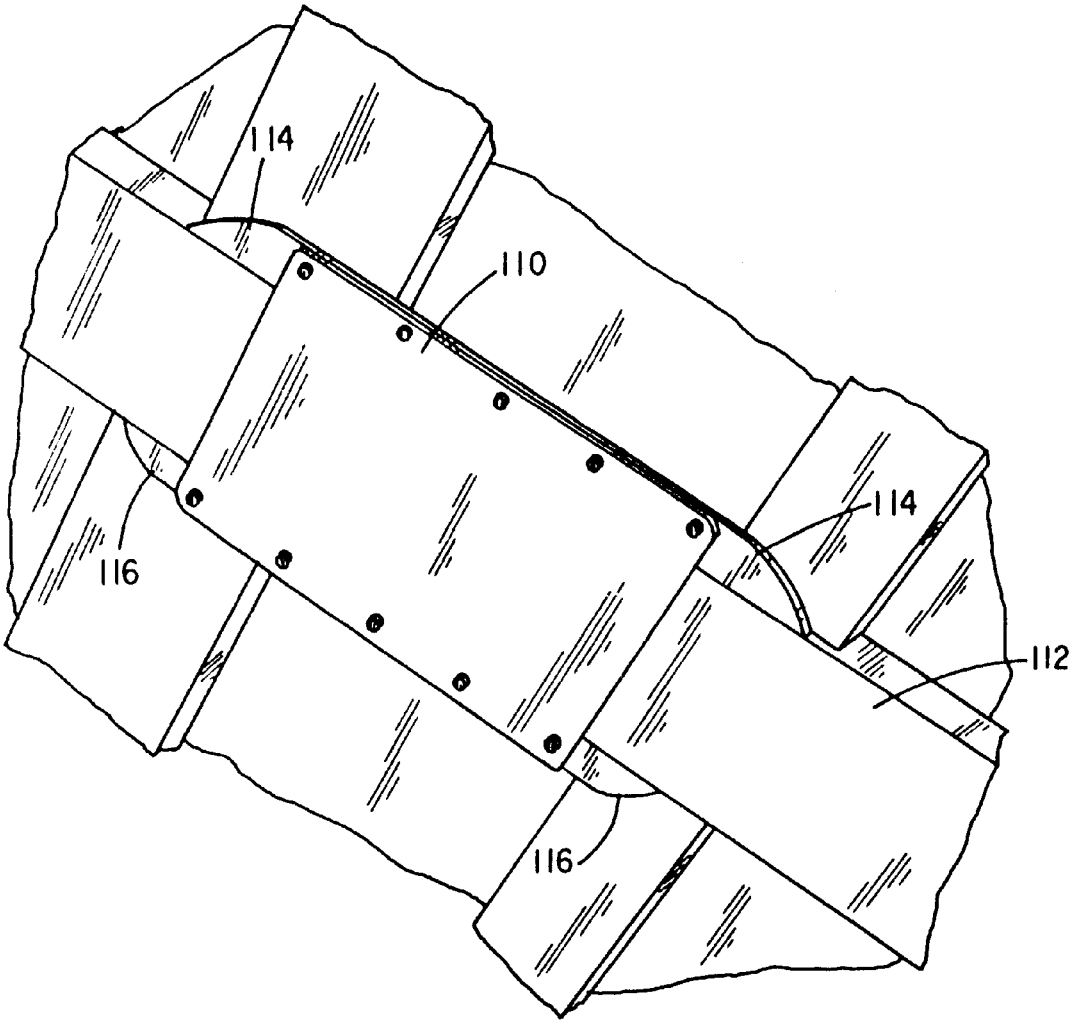
FIGS. 6A and 6B depict an access cover assembled and as removed exposing a wear shoe in accordance with the invention.
Figure 6B:
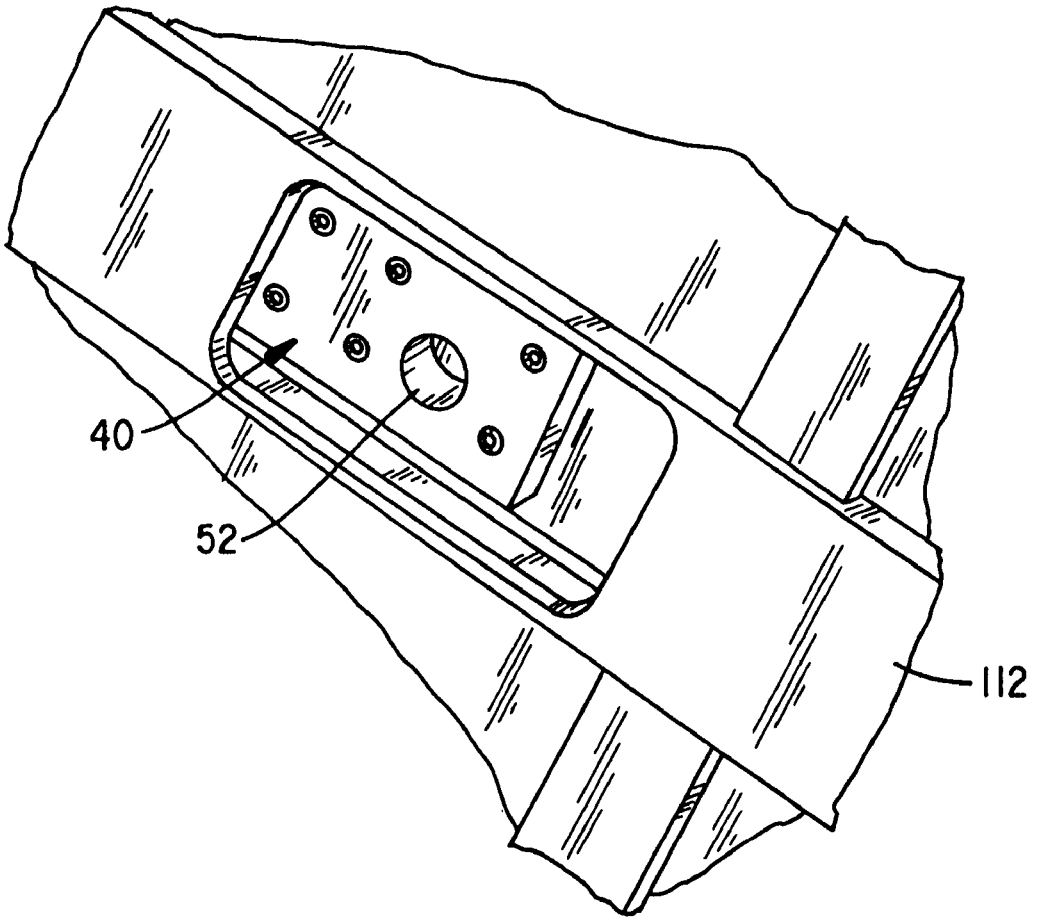

FIG. 4 further depicts a fragmentary side elevational schematic view of the slide wear shoe/slide guide assembly. Thus, a wear shoe 40 having upper and lower wear bars or pads 42 and 44 is shown riding between upper and lower wear surfaces 100 and 102 of the frame of the tailgate which includes outer wall 104 with protruding structural shapes as at 106 and 108 and a removable access plate is illustrated at 110. As illustrated, removal of the access plate 110 can expose the shoe 40 and replacement is accomplished by simply pulling off the worn shoe and replacing it with a new one over the pegs attached to the slide system (FIG. 3). This is further illustrated in FIGS. 6A and 6B in which the access plate 110 is shown bolted onto structural cross shape 112 utilizing extensions thereof at 114 and 116. In FIG. 6B, the system is shown removed and exposing a shoe 40 which can simply now be exchanged by pulling out the worn shoe and replacing it with a new one.

Figure 5:
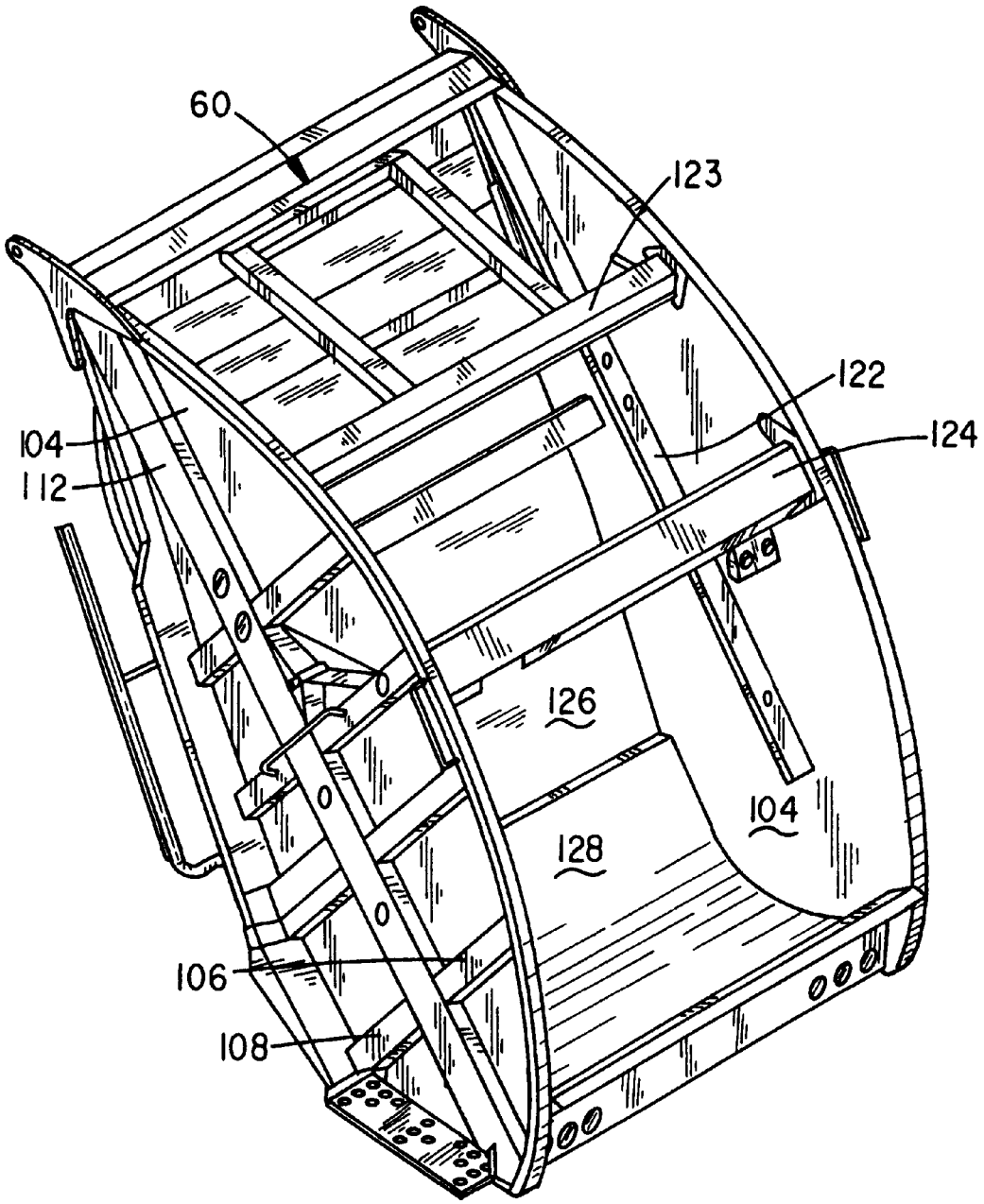
FIG. 5 is a fragmentary perspective view of a tailgate area of a rear-loading refuse truck with parts removed showing the slide guide location.

FIG. 5 shows a fragmentary perspective view with items removed of the tailgate area, generally 118, of a rear-loading refuse truck, including spaced steel plate sidewalls 104 inside a frame of structural shapes including spaced vertical stiffener shapes as at 106 and 108 spaced by elongated stiffener shapes 112 which also form recesses in the sidewall as at 122 which form the slide guides on which and in which the slide 60 operates reciprocally riding on the wear shoes 40, etc. Additional cross braces or struts as at 123 and 124, together with floor plate 126 and curvalinear shaped receiving area floor 128, also form part of the tailgate structure. The slide system operates in coordination with the rotating hydraulic packing mechanism 80 (FIG. 3) which has been removed from FIG. 5 to allow the slide track (guide) to be viewed. The packing mechanism 80 carried by the slide rotates to clear refuse loaded in the curved section on floor plate 128 to accomplish packing of the refuse into the main reservoir of the truck body. Thus, with the slide in the up or retracted position, refuse can be loaded into the tailgate onto the curved receiving floor 128 and, when it is desired to pack the refuse into the truck, the slide 60 carrying the packer blade is extended fully along the track 120 and 122 so that it, with the floor 126, 128 forms a passage through which the refuse is compacted into the main reservoir of the truck by operation of the packing mechanism.

The materials of construction of the wear shoes or wear surfaces of the shoes are an important aspect of the invention inasmuch as reduced surface friction, longer wearing (lower abrasion) and lighter weight materials are most desired. Shoe materials should be relatively inert to the refuse materials processed. Accordingly, high impact, abrasion resistant and self-lubricating polymer materials are preferred. Such materials offer corrosion resistance and greater wear surface life than conventional steel, bronze or other metallic surfaces. They are lighter weight and can readily be cast polymerized into the exact shape required for the particular application.

Examples of polymer products include a series of modified polyamide, particularly nylon products, examples of which are sold under the trademark "Nylatron" (Polymer Corporation, Reading, Pa.). One such material known as GSM cast nylon can be directly polymerized from the neonomer into the shape of the article desired producing either simple or complex shapes free of voids and in sizes larger than those possible with conventional extrusion. These nylons may also be modified by incorporation or impregnation with friction reducing oils and molybdenum disulfide ($MOS_2$) which improves mechanical thermal and bearing properties of type 6/6 nylon, for example.

Of course, other materials which have the requisite physical properties and lend themselves to manufacture in the desired shapes and sizes can also be used. Other examples of such material include polyetheretherketone (PEEK), modified, partially crystallized polyethylene terephthalate thermoplastic polyester, thermoplastic acetyls and other materials. It will further be appreciated that the various pads may be of shapes other than those exemplified by the detailed description, which is intended to be exemplary rather than limiting in any respect. Additionally, different materials including conventional metal materials, such as bronze, brass and steel, for example, in some cases, may also be used for the wear surfaces.

The material forming the central portion or core of the wear shoe separating and positioning the wear surfaces may be any lightweight, filler material capable of carrying the requisite amount of force exerted by the fastening pins and retaining the wear surfaces properly in place. Materials suitable for such purposes include many polymer materials including certain polymer materials known as ultra high molecular weight (UHMW) materials which may include high density polypropylene (HDPP) or high density polyethylene (HDPE), for example, and other such materials.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself. For example, the wear shoes of the invention may be employed in other comparable applications where comparable devices are indicated.

What is claimed is:

1. In a vehicle mounted, linearly reciprocating refuse treating mechanism designed to operate along and be carried by a guide system including:

(a) a vehicle body having spaced sidewalls and a floor;

(b) a pair of spaced parallel structural slide guides, one on either side of said vehicle body;

(c) a movable slide mechanism and connected reciprocating packing mechanism designed to operate along and so as to be carried by said moveable slide mechanism supported by said structural slide guides in said vehicle body;

(d) at least two wear shoes, at least one of which is disposed between each of said structural slide guides and said slide mechanism and supporting said mechanism, each of said wear shoes further comprising at least one low friction wear pad spaced by and fixed to a surface of a core of diverse material, said at least one wear pad being located on the surface of highest wear of said shoe;

(e) outward directed members fixed to said slide mechanism for carrying said wear shoes, said wear shoes having means for receiving said members so that said wear shoes are removably carried by said mechanism but not fixed to said mechanism; and (f) removable side plates on said vehicle body, the removal of which exposes a respective wear shoe for removal and exchange thereof.

2. The apparatus of claim 1 wherein each of said wear shoes comprises upper and lower wear pads.

3. The apparatus of claim 1 wherein said wear pads comprise a low friction abrasion resistant polymer material.

4. The apparatus of claim 3 wherein said wear pads include materials selected from the group consisting of polyamides, modified polyamides, polyetheretherketone, modified, partially crystallized polyethylene terephthalate, thermoplastic polyester, thermoplastic actyls, and other low friction materials.

5. The apparatus of claim 1 wherein said mechanism is selected from the group consisting of packing mechanisms, ejector mechanisms and slide mechanisms designed to cycle during refuse collection and ejection.

6. The apparatus of claim 5 wherein said wear pads are metal.

7. The apparatus of claim 1 wherein a filler material is provided and comprises ultra high molecular weight polymer material including high density polyethylene (HDPE).

8. The apparatus of claim 7 wherein said wear pads include materials selected from the group consisting of polyamides, modified polyamides, polyetheretherketone, modified, partially crystallized polyethylene terephthalate, thermoplastic polyester, thermoplastic actyls, other low friction materials and metals.

9. The apparatus of claim 1 wherein said outward directed members are pins and said wear shoes are slip fit on said pins.

10. A vehicle mounted tailgate for a rear loading refuse body including:

(a) a raisable tailgate mounted on a rear-loading refuse vehicle body said tailgate having spaced sidewalls and a floor, a tailgate receiving section having spaced sidewalls and a floor and a pivoting packing mechanism;

(b) a pair of spaced parallel slide guide mounts provided in the sides of said tailgate said pair of slide guides being carried an said slide guide mounts;

(c) a reciprocating slide mechanism designed to connect to carry and cooperate with said pivoting packing mechanism, said slide mechanism being designed to be reciprocally carried by said slide guides;

(d) wherein said pivoting packing mechanism connected to and carried by said slide mechanism supported by said slide guides in said tailgate;

(e) at least two wear shoes, one of which is disposed between said reciprocating slide mechanism and each said slide guides;

(f) wherein each of said wear shoes further comprises at least one low friction wear pad fixed to a core of diverse material, one of said wear pads being located on at least the upper friction surface of said shoe;

(g) a plurality of outward directed pins carried by said slide mechanism and wherein each of said wear shoes further comprises one or more spaced bores designed to accommodate one or more said pins so that each said wear shoe slips over one or more of said pins to mount on but not be fixed to said slide mechanism; and (h) wherein said tailgate is provided with openings in said side walls of a size to accommodate said wear shoes and removable access plate means covering said openings in said side walls to allow removal and replacement of said shoes and to retain same on said slide pins.

11. The apparatus of claim 10 wherein each of said wear shoes comprises upper and lower wear pads.

12. The apparatus of claim 10 wherein said wear pads are selected from high impact, abrasion resistant and self-lubricating polymer materials and metallic materials.

13. The apparatus of claim 12 wherein said wear pads include materials selected from the group consisting of polyamides, modified polyamides, polyetheretherketone, modified, partially crystallized polyethylene terephthalate, thermoplastic polyester, thermoplastic actyls, and other low friction materials.

14. The apparatus of claim 10 wherein each said wear shoe further comprises a wear pad on the lower surface thereof.

15. The apparatus of claim 10 wherein the wear pads of a shoe are of differing compositions.

16. The apparatus of claim 15 wherein said wear pads include materials selected from the group consisting of polyamides, modified polyamides, polyetheretherketone, modified, partially crystallized polyethylene terephthalate, thermoplastic polyester, thermoplastic actyls, other low friction materials and metals.

17. The apparatus of claim 15 wherein said core material is selected from ultra high molecular weight polymer materials including high density polyethylene (HDPE).

* * * * *